US005911526A

United States Patent [19]

Watanabe

[11] Patent Number: 5,911,526

[45] Date of Patent: Jun. 15, 1999

[54] PRINTING APPARATUS

[75] Inventor: Naoya Watanabe, Yokohama, Japan

[73] Assignee: Canon Kabushiki Kaisha, Tokyo, Japan

[21] Appl. No.: 08/662,947

[22] Filed: Jun. 13, 1996

[30] Foreign Application Priority Data

Jun. 21, 1995 [JP] Japan ..... 7-154427

[51] Int. Cl.[6] ..... B41J 29/393

[52] U.S. Cl. ..... 400/74; 347/14; 347/19

[58] Field of Search ..... 400/74; 347/5, 347/14, 84, 19

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,049,898 | 9/1991 | Arthur et al. | 346/1.1 |
| 5,132,711 | 7/1992 | Shinada et al. | 346/140 R |
| 5,315,397 | 5/1994 | Inoue et al. | 358/296 |
| 5,481,374 | 1/1996 | Tachibana et al. | 358/444 |
| 5,663,750 | 9/1997 | Sakuma | 347/7 |

FOREIGN PATENT DOCUMENTS

| | | |
|---|---|---|
| 04-47262 | 9/1991 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

OTHER PUBLICATIONS

Rober Cowort, "Mastering Windows 3.1 Special Addition", Sybex inc., pp. 208–221, 1993.

*Primary Examiner*—John Hilten

*Attorney, Agent, or Firm*—Fitzpatrick, Cella, Harper & Scinto

[57] ABSTRACT

An image printing apparatus which enables an appropriate operation in accordance with a user's judgment even when printing operation is halted due to no ink residue. After the printing operation is halted due to running out of ink residue, the user judges whether or not a page, where printing operation is performed at the time of detection of no ink residue, is to be printed again, or to delete the image data corresponding to the printed page from an image memory. If any subsequent printing operation is necessary, an ink cartridge is exchanged and the printing operation is resumed. Ink residue detection is performed for the resumed printing operation, and image data is deleted or maintained according to the detected result.

23 Claims, 5 Drawing Sheets

PRINTING APPARATUS

BACKGROUND OF THE INVENTION

Present invention relates to a printing apparatus and, more particularly, to a printing apparatus such as a facsimile apparatus having a printing unit which performs printing in accordance with an inkjet printing method.

Conventionally, a printing apparatus which utilizes an inkjet printing method or a facsimile apparatus having such printing apparatus as its printing unit employs an exchangeable ink cartridge integrating a printhead as well as an ink tank, and a standard-size cut sheet as a print sheet.

Further, in the conventional facsimile apparatus, in order to handle a situation where ink runs out during image reception, residue of ink is detected each time a page of received image is outputted, and it is controlled such that the received image data is maintained in an image memory when there is no residual ink.

In the above conventional example, however, a user of the apparatus has to output the image stored in the image memory by manual operation. Since the stored image data is not deleted from a memory unless the image is outputted, the user might have to output unnecessary received image data together with necessary data for deleting the data from the memory.

Even in a case of a printing apparatus comprising a function for deleting received image data, all image data of the page where it is determined to have no ink residue is deleted along with those included in the subsequent pages. Therefore, it is not friendly in view of user's operability and availability.

SUMMARY OF THE INVENTION

The present invention has been made in consideration of the above situation, and it is an object of the present invention to provide a printing apparatus which can appropriately handle a case where ink of the apparatus runs out, by judgment and operation of a user.

According to the present invention, the foregoing object is attained by providing an image printing apparatus for printing an image using printing means in which a printhead discharges ink on a recording medium, comprising: storing means for storing image data received via a communication line; a removable ink cartridge for storing the ink; determining means for determining whether or not there is ink residue in said ink cartridge; control means for controlling such that when said determining means determines that there is no residual ink during printing of the received image data by said printing means, the printing operation is halted, and the image data corresponding to a page where it is determined by said determining means that there is no ink residue and image data corresponding to the subsequent pages are maintained in said storing means; selecting means for selecting whether or not image data, corresponding to the page where it is determined by said determining means that there is no ink residue, maintained by said storing means is to be deleted; deleting means for deleting the image data, corresponding to the page selected by said selecting means, from said storing means; and print control means for controlling said printing means to output the image data maintained by said storing means.

In accordance with the present invention as described above, when it is detected that there is no residual ink in a removable ink cartridge which stores ink, while image data received via a communication line is printed by an image processing apparatus such as a facsimile apparatus, which comprises printing means for printing image data on a printing medium by discharging ink from a printhead, it is possible to terminate the printing operation and store image data corresponding to the currently-printing page as well as the page thereafter in storing means, and to instruct as such that the stored image data be deleted from the storing means or output the image data.

It is another object of the present invention to provide an image processing controller which can handle a situation by judgment made by a user of the apparatus, when ink runs out.

The foregoing object is attained by providing an image processing controller for controlling printing means in which a printhead discharges ink from a detachable ink cartridge on a recording medium, comprising: storing means for storing image data; determining means for determining whether or not there is ink residue in said ink cartridge; control means for controlling such that when said determining means determines that there is no residual ink during printing of the received image data by said printing means, the printing operation is halted, and the image data corresponding to a page where it is determined by said determining means that there is no ink residue and image data corresponding to the subsequent pages are maintained in said storing means; selecting means for selecting whether or not image data, corresponding to the page where it is determined by said determining means that there is no ink residue, maintained by said storing means is to be deleted; deleting means for deleting the image data, corresponding to the page selected by said selecting means, from said storing means; and print control means for controlling said printing means to output the image data maintained by said storing means.

It is still another object of the present invention to provide an image printing control method capable of handling a situation where ink runs out by judgment made by a user of an apparatus.

The foregoing object is attained by providing an image printing control method of controlling printing operation in which a printhead discharges ink from a detachable ink cartridge on a recording medium, comprising: a storing step of storing image data in a storage medium; a determining step of determining whether or not there is ink residue in the ink cartridge; a control step of controlling such that when it is determined in said determining step that there is no residual ink during printing operation utilizing the image data, the printing operation is halted, and the image data corresponding to a page where it is determined in said determining step that there is no ink residue and image data corresponding to the subsequent pages are maintained in the storage medium; a selecting step of selecting whether or not image data, corresponding to the page where it is determined in said determining step that there is no ink residue, maintained in said storing medium is to be deleted; a deleting step of deleting the image data, corresponding to the page selected in said selecting step, from the storage medium; and a print control step of controlling the printing operation to output the image data maintained in the storage medium.

The invention is particularly advantageous since it is possible to perform output control and storing control of image data of which printing is interrupted due to no ink residue, in accordance with judgment made by a user of an apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

Preferred embodiment of the present invention will be described in detail in accordance with the accompanying drawings.

Figure 1:
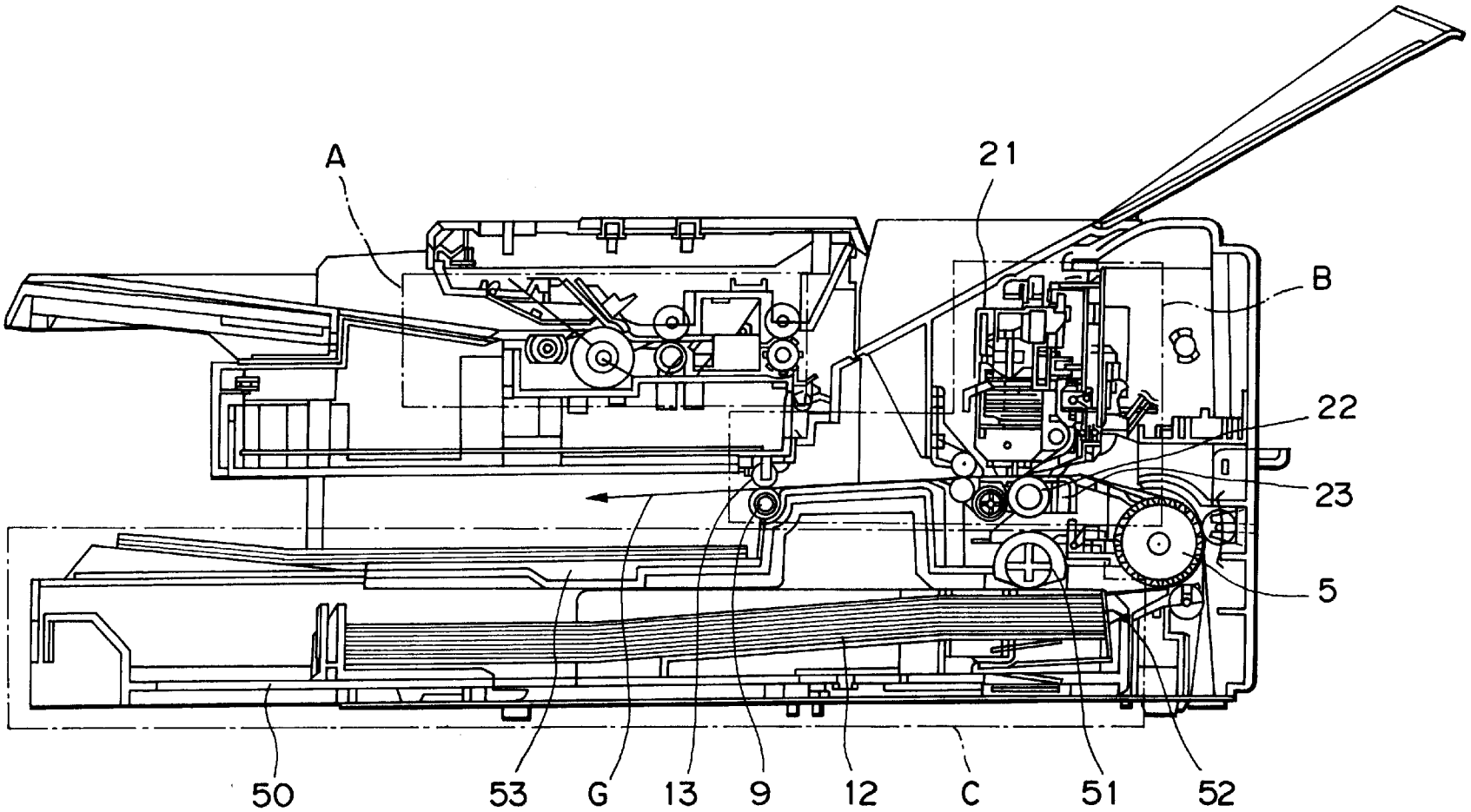
FIG. 1 is a sectional side view showing a structure of a facsimile apparatus, which is a typical embodiment of the present invention.

FIG. 1 is a sectional side view showing a structure of a facsimile apparatus which is a typical embodiment of the present invention. In FIG. 1, reference portion A denotes a reading unit for optically reading an original image; B, a printer unit having a printhead which performs printing operation according to an inkjet printing method and an ink tank which supplies ink to the printhead; and C, a paper feed unit for separately supplying a cut-sheet as a print sheet loaded in a cassette one by one to the printer unit B. The printhead and ink tank integratedly construct an exchangeable ink cartridge.

In the apparatus having a structure shown in FIG. 1, printing operation on a print sheet is performed in the manner described below. A print sheet 12 loaded in a cassette 50 is picked up by a feeding roller 51 and a separation claw 52, and conveyed by a conveying roller 5 to be fed to the printer unit B. Then, in the printer unit B, a printhead 21 reciprocally scans in a vertical direction of the drawing sheet of FIG. 1 and performs printing operation by discharging ink on the print sheet. The scanning direction of the printhead 21 is called main scanning direction. Each time one scanning of printing operation is completed, the print sheet 12 is conveyed in a direction of an arrow G for a width of one scanning of the printhead 21. Printing operation proceeds in the above described manner. When printing operation for the print sheet 12 is completed, the print sheet 12 is outputted by a discharging roller 9 to a stacker 53 to be stacked.

Note that a photosensor 13 is arranged in the upper portion of the discharging roller 9. A footer mark printed at the bottom of the print sheet 12 is read by the photosensor 13, and ink residue of an ink cartridge can be determined based upon the printed density.

Further in FIG. 1, reference numeral 22 denotes a conveying roller; and 23, a print sheet sensor. Detailed descriptions of the photosensor 13, the conveying roller 22 and the print sheet sensor 23 will be given later with reference to FIG. 2.

Figure 2:
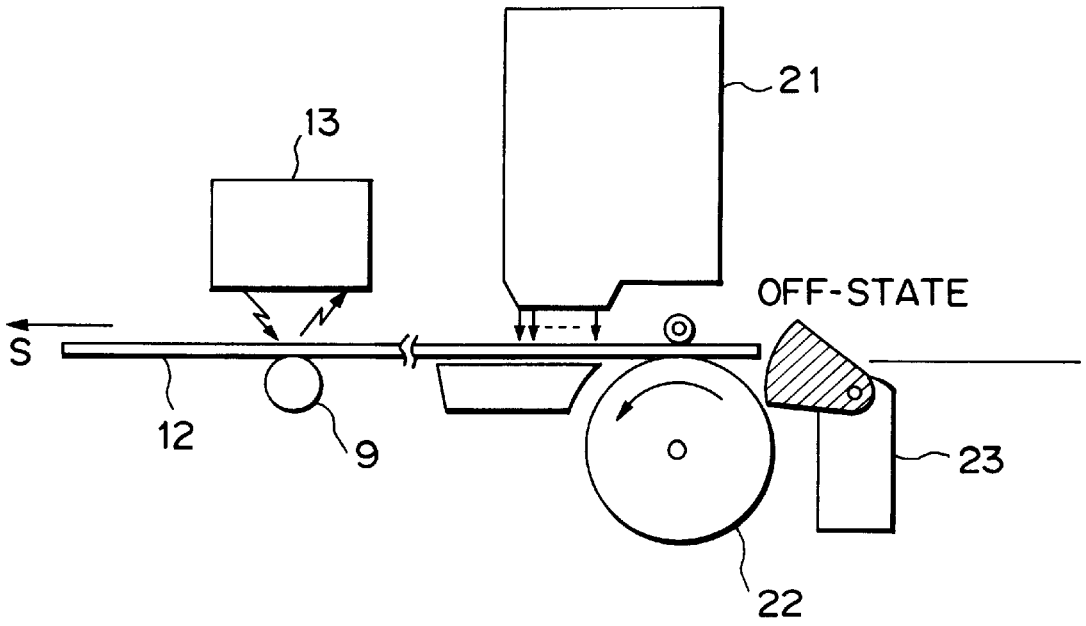
FIG. 2 is a general view showing a peripheral structure of a printhead.

FIG. 2 is a general view showing a peripheral structure of the printhead 21 in the printer unit B. The printhead 21 comprises sixty-four nozzles arranged in a conveying direction of a print sheet (sub-scanning direction) shown with an arrow S and discharges ink droplets from an orifice of the nozzle by the pressure of film boiling generated in ink caused by heat generation of an electrothermal transducer embodied in each of the nozzles. The printhead 21 is capable of printing with a resolution of 360 dpi.

The conveying roller 22 can convey a print sheet in a sub-scanning direction with a precision corresponding to a printing resolution of the printhead 21 at the time of feeding, printing, and discharging the print sheet 12.

FIG. 2 illustrates a state in which the print sheet 12 is conveyed in a sub-scanning direction by the conveying roller 22 and reached outside a detection area (the area of oblique lines) of the print sheet sensor 23. In such state, the print sheet sensor 23 is turned "OFF." Meanwhile, when the print sheet 12 is within the detection area of the print sheet sensor 23 on the conveyance path, the print sheet sensor 23 is turned "ON." Therefore, according to the state of "ON" or "OFF" of the print sheet sensor 23, the following can be detected:

(1) whether or not a print sheet is near the printhead 21;

(2) whether or not a top portion of the print sheet 12 is near the printhead 21; and (3) whether or not a bottom portion of the print sheet 12 is near the printhead 21.

The photosensor 13 is a reflection-type photosensor configured with an LED which irradiates light on a print sheet and a photo transistor which receives the reflected light. In the portions where an image is printed on a printing sheet, a percentage of an area on which ink is applied in a unit-area of a print sheet (hereinafter referred to as "black area rate") is high; on the other hand, in the portions where no image is printed in a print sheet, the black area rate is low. Generally, a color with a high reflectivity such as white or yellow is used for a print sheet. The reflectivity of ink is low compared to the reflectivity of a print sheet. Therefore, when light is irradiated from the LED on a printed print sheet and the reflection light is received with the photo transistor, the reflection light is weak and the photoelectric current generated by the photo transistor is low in the area where an image is printed, but the reflection light is strong and the photoelectric current generated by the photo transistor is high in the area where no image is printed.

Note that since the reflectivity or absorptivity varies depending on a type of ink utilized in an apparatus, a wave band of the LED light must be selected considering which type of ink is utilized. In the present embodiment, ink having high absorptivity of red wave-length is utilized; therefore, the LED which irradiates red light is selected. Moreover, since the photosensor 13 must be arranged near the print sheet discharging portion, taking the apparatus' structure into consideration, it is arranged in a position where external light cannot give any effects thereupon. An operation of the photosensor 13 is turned off when no print sheet 12 exists on the discharging roller 9.

In the apparatus according to the present embodiment, it is controlled such that a predetermined pattern of a footer mark is printed at the bottom portion of the print sheet upon completion of printing operation for each page of the print sheets. Accordingly, after the print sheet sensor 23 detects the bottom portion of the print sheet, the photosensor 13 irradiates light on the print sheet at a predetermined timing to examine an image density of the footer mark. If the image density is higher than a threshold value, the apparatus judges that the printing operation for that page is properly completed, and image data corresponding to that page stored in a memory (which will be described later) in the apparatus is deleted. On the contrary, if the image density is lower than the predetermined threshold value, it is judged that there is no ink residue. In this case, there is a possibility that printing of that page might not be properly completed; therefore, the corresponding image data is kept in the memory. It is controlled to maintain also the subsequent received image data in the memory.

Note that when an ink cartridge is exchanged and the printing operation is resumed to print the image data maintained in the memory, a user can arbitrary select whether or not the image data, corresponding to the page where it is determined to have no ink residue, is to be used.

Figure 3:
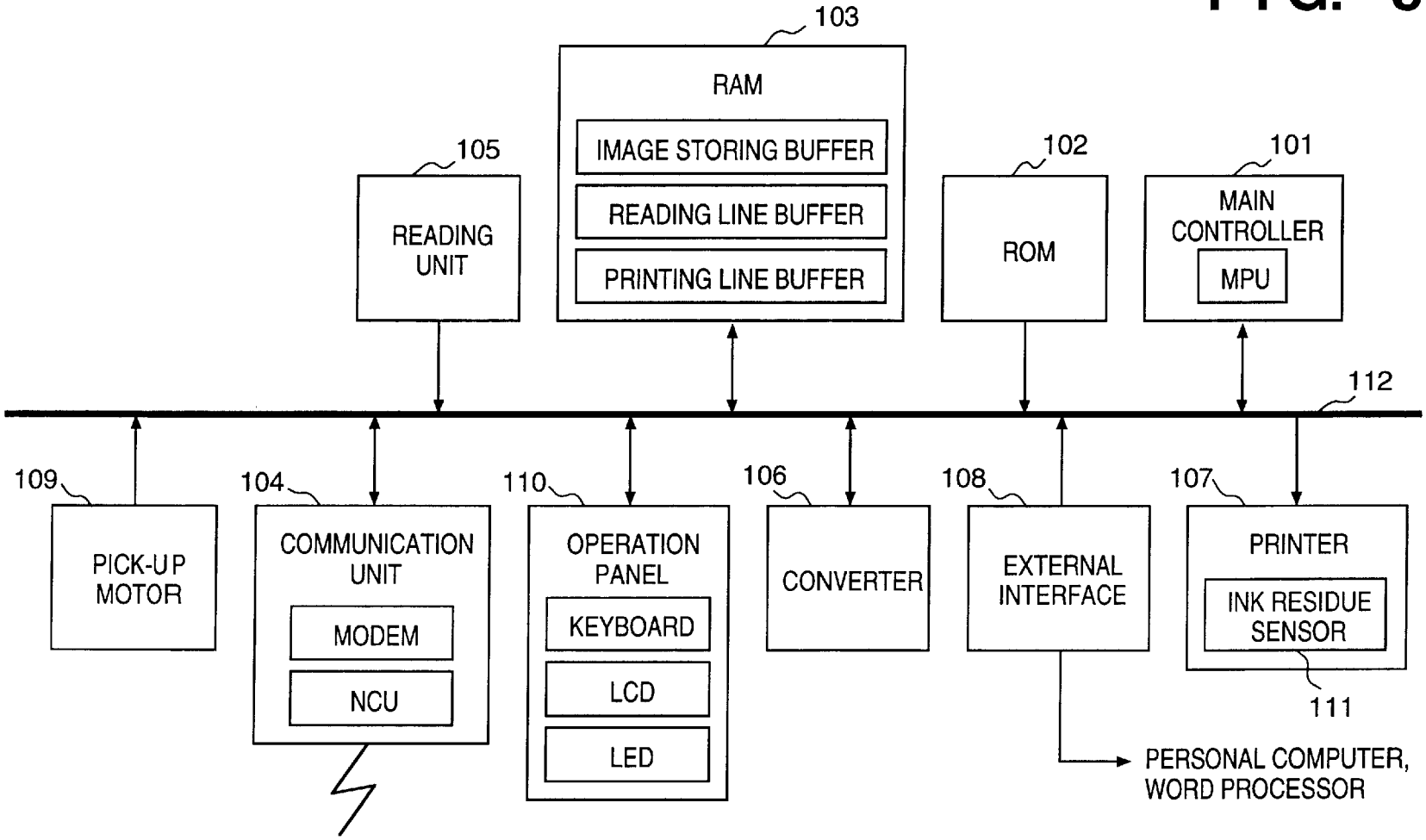
FIG. 3 is a block diagram showing a functional configuration of a facsimile apparatus shown in FIG. 1.

FIG. 3 is a block diagram showing a functional configuration of the facsimile apparatus shown in FIG. 1.

In FIG. 3, reference numeral 101 denotes a main controller comprising an MPU for controlling operations of the entire apparatus; 102, a ROM for storing various programs to be executed by the MPU, initial value data, table data, font data for TTI or the like; and 103, a RAM utilized as a work area for various processes executed by the MPU, a buffer for storing images, a line buffer for reading, a line buffer for printing, an area for registering user's information, and an area for storing received footers.

Font data for TTI stored in the ROM 102 is the font data for numbers, alphabets, katakana or symbols which are utilized to add originator's information to image data at the time of transmitting the image data. The buffer for storing images allotted to the RAM 103 is utilized for storing received image data as well as image data not yet outputted, and hereinafter referred to as an image memory. The line buffer for reading is utilized for storing image data which corresponds to four lines of read image data (equivalent to 1728 pixels (=216 byte) per line in G3 standard) generated by reading an original image for facsimile transmission. The line buffer for printing is utilized for storing image data (400 byte×4 lines) corresponding to four lines of image data for printing.

Reference numeral 104 denotes a communication unit having a modem for image communication (MODEM) and an NCU or the like; 105, a reading unit having a contact-type sensor composed of a CCD or the like for reading an image, an LSI dedicated for image processing of the read image, and reading control unit; 106, a converter for converting image data in the form of run-length (RL) decoded by the main controller 101 to data (raw data) representing information of each pixel; and 107, a printer complying with an inkjet printing method for performing outputting of received image data, outputting of communication reports which show communication management, outputting of copied sheets, or outputting of images in accordance with image data sent from an external apparatus such as a word processor or a personal computer.

Note that the reading unit 105 and the printer 107 mechanically correspond to the reading unit A and the printer unit B in FIG. 1 respectively.

Reference numeral 108 denotes an external interface conforming to centronics, where data is received by external apparatuses being connected thereto; 109, a pick-up motor for picking up a placed original sheets one by one and conveying to the reading unit 105; and 110, an operation panel having a keyboard which includes a copy key, a printer key or the like, and an LCD, LED or the like for displaying various messages. Reference numeral 111 denotes an ink residue sensor for determining whether or not there is residual ink in an ink cartridge embodied in the printer 107; and 112, a system bus for interconnecting components of the apparatus. Note that the ink residue sensor 111 mechanically corresponds to the photosensor 13 shown in FIGS. 1 and 2.

With the above described configuration, the present apparatus performs various functions such as facsimile communication, image reading, image storing management, user registration and image printing operation.

Figure 4:
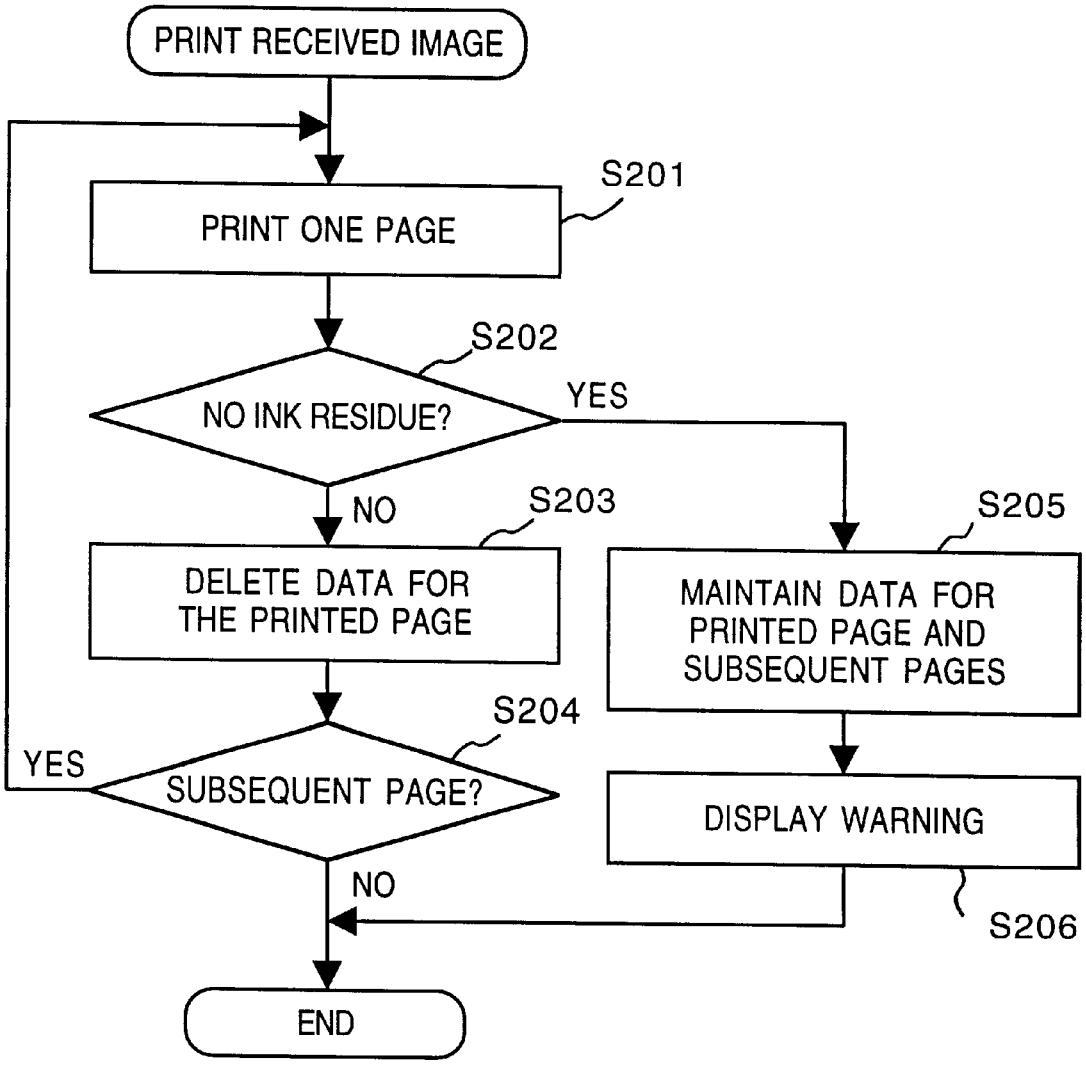
FIG. 4 is a flowchart describing printing operation of received data and control thereof.

Next, a printing operation and a control thereof in image reception of a facsimile according to the apparatus having above described structure are described, with reference to a flowchart shown in FIG. 4. Note that the present apparatus manages received image data which is stored in the image memory, in a unit of one print sheet. It is assumed in the process described below that image data has been already received by a facsimile apparatus and stored in its image memory.

First, in step S201, printing operation is performed for one page of print sheet, and in step S202 ink residue in the ink cartridge is examined utilizing the ink residue sensor 111. If it is judged that there is residual ink, the processing proceeds to step S203 where the image data corresponding to the page where printing has been just completed in step S201 is deleted. The processing then proceeds to step S204 where it is determined whether or not there is any received image data to be printed in a following page. If it is determined that there is no image data for the following page, the processing ends; however if it is determined that there is image data for the following page, the processing returns to step S201 and the printing operation is performed on the subject page.

As set forth above, the unit of deleting image data is one page in the present apparatus.

Meanwhile, if it is judged that there is no residual ink in step S202, the processing proceeds to step S205 where the received image data for the page in which printing has been executed in step S201 is maintained in the image memory, then a warning message "no ink" is displayed in the LCD of the operation panel 110 in step S206, the LED is lit or blinked, and the processing ends. The warning message can include not only the "no ink" message but also additional information such as pages of image data currently stored in the image memory.

Accordingly, as a result of the "no ink" warning where it is judged that the printing operation cannot be normally performed, the received data stored in the image memory in step S205 is determined to be non-printed received data of the page where "no ink" is determined during the printing operation, along with the subsequent pages, if any.

In the above described control, the ink residue sensor 111 determines "no ink" after printing operation for one page is completed; in other words, the printing operation continues until the end of the page, and when printing of the page is completed, the printing operation for the subsequent pages is terminated.

Accordingly, even if the timing at which the ink residue actually runs out is in the middle of printing a page, the printing operation of that page continues; therefore, the image data included in the page is printed and also maintained in the image memory. In practice, it is indeterminate that at which portion of a page the ink in the ink cartridge runs out. If the ink runs out at the top of the page, the output of the page is white for most part, but if the ink runs out at the bottom of the page, outputting of the page is almost complete. Accordingly, depending on the printing result, the printed image may be actually usable as image data.

Figure 5:
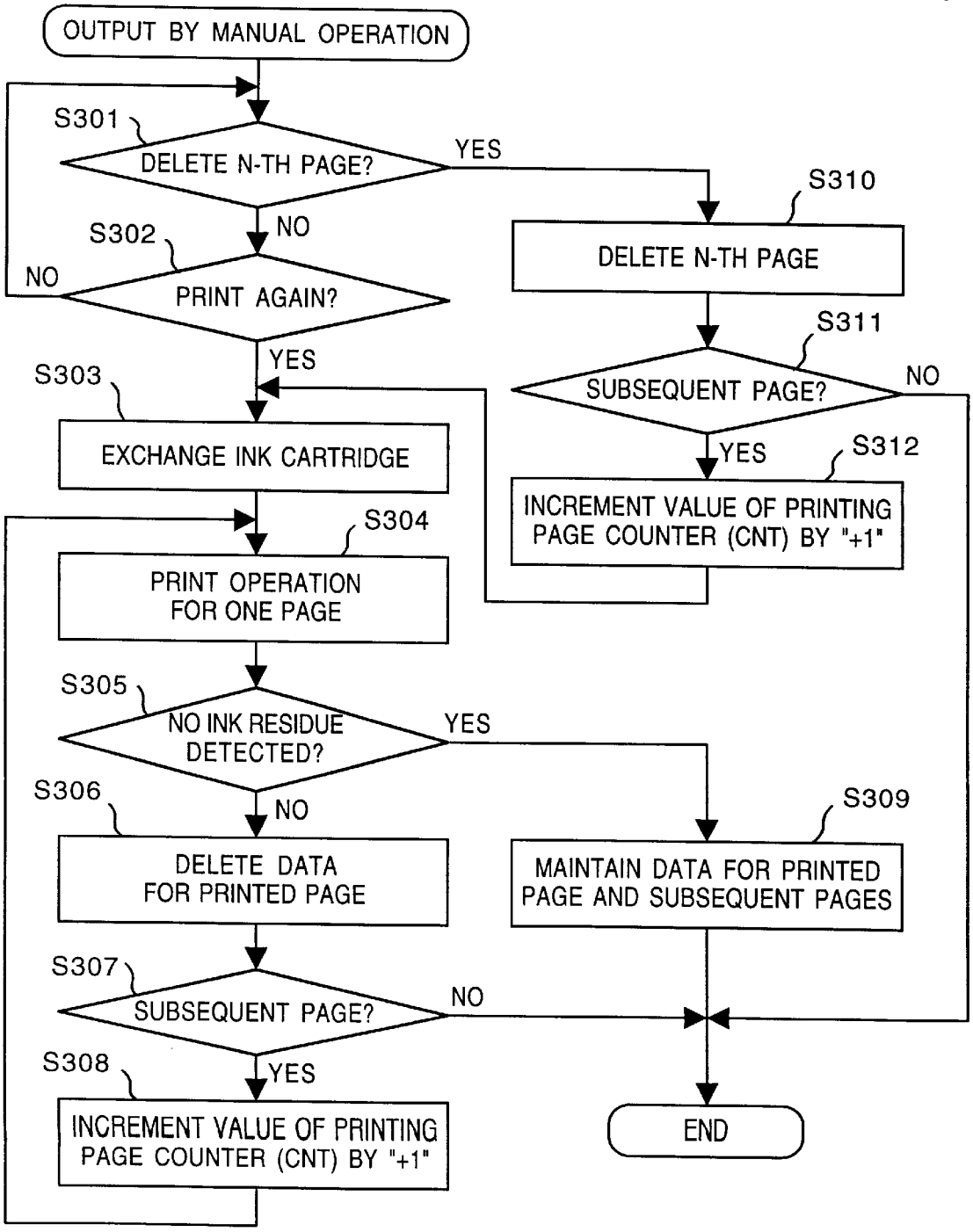
FIG. 5 is a flowchart describing output operation of received data by manual operation.

Depending on the content of the warning message displayed in the LCD and the result of the outputted printed image, a user of the apparatus can output the image data by manual operation as shown in the flowchart in FIG. 5. Hereinafter, descriptions are given for a case where "no ink" is detected at the n-th page.

In step S301, it is judged whether or not received data in the n-th page stored in the image memory is to be deleted. The judgment relies upon the user of the apparatus. When the user judges that the received data is not to be deleted, the processing proceeds to step S302 where it is selected whether or not the n-th page is to be printed again. The selection also relies upon the user's decision. When the user selects that the n-th page is to be printed again, the processing proceeds to step S303 where an ink cartridge is exchanged by a user, then proceeds to step S304. Meanwhile, if the user selects not to print the n-th page again, the processing returns to step S301.

When it is judged that the received data in the n-th page stored in the image memory is to be deleted in step S301, the processing proceeds to step S310 where the received data in the n-th page is deleted. The deleting operation is actualized by the user from the operation panel 110 by operating a keyboard according to a message displayed in the LCD. In the next step S311, it is judged whether or not any subsequent received data (that is, the (n+1)th page) exists, and if there is no existing data in the image memory, the processing ends. If there is existing data, the processing proceeds to step S312 where a value of a printing page counter (CNT), which is set in the RAM 103 for printing control, is incremented (+1) and the processing proceeds to step S303. As set forth above, in step S303, an ink cartridge is exchanged. In this manner, it is possible to control such that printing operation cannot be resumed unless an ink cartridge is exchanged, preventing the data to be erroneously deleted from the image memory, when the image memory contains image data not yet printed.

Next in step S304, the image data in the n-th page or (n+1)th page is printed. In the following step S305, it is determined whether or not "no ink" has been detected after the printing operation of step S304. If "no ink" is detected, the processing proceeds to step S309 where the image data of the page on which printing has been performed in step S304 and the subsequent pages, if any exist, are maintained in the image memory, and the process ends. Meanwhile, if it is detected that there is residual ink, the processing proceeds to step S306 where the n-th page or the (n+1)th page of the image data is deleted from the image memory. The deleting operation is identical to the operation in step S310.

As set forth above, the reason that ink residual determination is performed again in step S305 is to detect erroneous setting of an old empty ink cartridge, while a newly-set ink cartridge set in step S303 is expected to have enough residual ink therein.

In the next step S307, it is determined whether or not there is any received data following the deleted page, and if there is no received data, the processing ends. If there is subsequent data exists, the value of the printing page counter (CNT) is incremented (+1) in step S308 and the processing returns to step S304.

According to the present embodiment, even when a printing operation is interrupted due to running out of ink, a user can control outputting and deleting of image data by referring to the printed sheet and a displayed warning message, utilizing image data stored in the image memory.

Note that in the present embodiment, ensuing printing operation is interrupted and image data following the page where it is determined to have no ink residue is maintained in accordance with the determination of no ink residue. It is also possible to maintain the image data when paper jam is detected during printing operation. In this case, a detection sensor for detecting paper jam or any equivalent mechanism is necessary in a printer.

Further, the present invention is not limited to the case where outputting and deleting of image data in which no ink residue is detected is performed as described in the above embodiment, but may also include the conventional function where image data stored in the image memory is deleted altogether.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting surface arranged in a flexed region may be also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

In addition, an exchangeable chip type printhead, which can be electrically connected to the apparatus main unit and can receive an ink from the apparatus main unit upon being mounted on the apparatus main unit is applicable to the present invention.

It is preferable to add recovery means for the printhead, preliminary auxiliary means, and the like provided as an arrangement of the printer of the present invention, since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in the above-mentioned embodiment of the present invention, it is assumed that the ink is liquid. Alternatively, the present invention may employ an ink which is solid at room temperature or less, or an ink which softens or liquefies at room temperature, or an ink which liquefies upon application of a printing signal, since it is a general practice to perform temperature control of the ink itself within a range from 30° C. to 70° C. in the ink-jet printing method, so that the ink viscosity will fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite to electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the printing apparatus of the present invention may be used in the form of a copying machine combined with a reader, and the like, in addition to an image output terminal of an information processing equipment arranged integrally or separately, such as a computer.

The present invention can be applied to a system constituted by a plurality of devices, or to an apparatus comprising a single device. Furthermore, it goes without saying that the invention is applicable also to a case where the object of the invention is attained by supplying a program to a system or an apparatus.

As many apparently widely different embodiments of the present invention can be made without departing from the spirit and scope thereof, it is to be understood that the inventions not limited to the specific embodiments thereof except as defined in the appended claims.

What is claimed is:

1. An image printing apparatus for printing an image using printing means in which a printhead discharges ink on a recording medium, comprising:

storing means for storing image data received via a communication line, said storing means storing image data in units of one page;

determining means for determining whether ink has been exhausted;

control means for controlling such that in response to a determination by said determining means that ink has been exhausted, a printing operation is halted after completion of printing of image data for a current page, and the image data corresponding to the current page and image data corresponding to subsequent pages are maintained in said storing means;

selecting means for selecting whether or not image data corresponding to only the current page maintained by said storing means is to be deleted;

deleting means for deleting only the image data corresponding to the current page selected by said selecting means from said storing means; and print control means for controlling said printing means to output the image data maintained by said storing means.

2. The apparatus according to claim 1, further comprising:

instructing means for instructing whether or not printing operation is to be performed again utilizing the image data corresponding to the current page, where it is determined by said determining means that there is ink exhaustion, which has been stored by said storing means.

3. The apparatus according to claim 2, wherein said print control means controls said printing means in accordance with the instruction from said instructing means.

4. The apparatus according to claim 1, further comprising notifying means for giving a user of the apparatus a warning when it is determined to have no ink by said determining means.

5. The apparatus according to claim 4, wherein said notifying means includes:

display means for displaying the warning as a message; and clarifying means for clarifying the warning by turning on or blinking a light.

6. The apparatus according to claim 1, further comprising, automatic deleting means for automatically deleting image data, corresponding to said image printing, from said storing means every time one page of image printing is completed in image printing utilizing the received image data by said printing means.

7. The apparatus according to claim 1, further comprising:

a detachable ink cartride for storing the ink; and detection means for detecting whether or not there is ink residue in said ink cartridge.

8. The apparatus according to claim 7, wherein after the printing operation is halted by said control means, printing operation is resumed upon exchange of said ink cartridge.

9. The apparatus according to claim 8, further comprising determining control means for controlling said determining means to again perform determination of ink residue after the printing operation which has been resumed is completed for one page.

10. The apparatus according to claim 1, wherein the printhead is for discharging ink utilizing heat energy, and comprises heat energy transducers for generating heat energy to be provided to ink.

11. The apparatus according to claim 1, wherein said image printing apparatus includes a facsimile apparatus.

12. An image processing controller for controlling printing means in which a printhead discharges ink on a recording medium, comprising:

storing means for storing image data in units of one page;

determining means for determining whether ink has been exhausted;

control means for controlling such that in response to a determination by said determining means that ink has been exhausted, a printing operation is halted after completion of printing of image data for a current page, and the image data corresponding to the current page and image data corresponding to subsequent pages are maintained in said storing means;

selecting means for selecting whether or not image data corresponding to only the current page maintained by said storing means is to be deleted;

deleting means for deleting the image data corresponding to the current page selected by said selecting means from said storing means; and print control means for controlling said printing means to output the image data maintained by said storing means.

13. The controller according to claim 12, further comprising:

instructing means for instructing whether or not printing operation is to be performed again utilizing the image data corresponding to the current page, where it is determined by said determining means that there is ink exhaustion which has been stored by said storing means.

14. The controller according to claim 12, wherein said print control means controls said printing means in accordance with the instruction from said instructing means.

15. The controller according to claim 12, further comprising notifying means for giving a user of the apparatus a warning when it is determined to have no ink by said determining means.

16. The controller according to claim 15, wherein said notifying means includes:

display means for displaying the warning as a message; and clarifying means for clarifying the warning by turning on or blinking a light.

17. The controller according to claim 12, further comprising, automatic deleting means for automatically deleting image data, corresponding to said image printing, from said storing means every time one page of image printing is completed in image printing utilizing the image data by said printing means.

18. The controller according to claim 12, further comprising:

a detachable ink cartridge for storing the ink; and detection means for detecting whether or not there is ink residue in said ink cartrige.

19. The controller according to claim 18, wherein after the printing operation is halted by said control means, printing operation is resumed upon exchange of said ink cartridge.

20. The controller according to claim 19, further comprising determining control means for controlling said determining means to again perform determination of ink residue after the printing operation which has been resumed is completed for one page.

21. The controller according to claim 12, wherein the printhead is for discharging ink utilizing heat energy, and comprises heat energy transducers for generating heat energy to be provided to ink.

22. An image printing control method of controlling printing operation in which a printhead discharges ink on a recording medium, comprising:

a storing step of storing image data in units of one page in a storage medium;

a determining step of determining whether ink has been exhausted;

a control step of controlling such that in response to a determiniation in said determining step that ink has been exhausted, a printing operation is halted after completion of printing of image data for a current page, and the image data corrsponding to the current page and image data corresponding to subsequent pages are maintained in the storage medium;

a selecting step of selecting whether or not image data corresponding to only the current page maintained in said storing medium is to be deleted;

a deleting step of deleting only the image data corresponding to the current page selected in said selecting step from the storage medium; and a print control step of controlling the printing operation to output the imae data maintained in the storage medium.

23. The method according to claim 22, wherein the ink is supplied from a detachable ink cartridge, and further comprising a detecting step of detecting whether or not there is ink residue in the ink cartridge.

* * * * *